US011697485B2

(12) United States Patent
Remes et al.

(10) Patent No.: US 11,697,485 B2
(45) Date of Patent: Jul. 11, 2023

(54) MANOEUVRING SYSTEM FOR A VESSEL

(71) Applicant: G-Boats Oy, Helsinki (FI)

(72) Inventors: Timo Remes, Helsinki (FI); Paavo Pietola, Helsinki (FI)

(73) Assignee: G-Boats Oy, Helsinki (FI)

( * ) Notice: Subject to any disclaimer, the term of this patent is extended or adjusted under 35 U.S.C. 154(b) by 141 days.

(21) Appl. No.: 17/399,087

(22) Filed: Aug. 11, 2021

(65) Prior Publication Data

US 2022/0048608 A1 Feb. 17, 2022

(30) Foreign Application Priority Data

Aug. 11, 2020 (EP) ..... 20190469

(51) Int. Cl.

| | |
|---|---|
| ***B63H 25/46*** | (2006.01) |
| ***B63B 39/08*** | (2006.01) |
| ***B63B 43/18*** | (2006.01) |
| ***B63H 11/04*** | (2006.01) |
| ***B63H 25/02*** | (2006.01) |

(52) U.S. Cl.

CPC ..... *B63H 25/46* (2013.01); *B63B 39/08* (2013.01); *B63B 43/18* (2013.01); *B63H 11/04* (2013.01); *B63H 25/02* (2013.01)

(58) Field of Classification Search

CPC ..... B63H 25/00; B63H 25/02; B63H 25/46; B63H 11/00; B63H 11/04; B63B 39/00; B63B 39/08; B63B 43/00; B63B 43/18

USPC ..... 114/151

See application file for complete search history.

(56) References Cited

U.S. PATENT DOCUMENTS

| | | | |
|---|---|---|---|
| 3,620,183 | A | 11/1971 | Hull |
| 6,142,841 | A | 11/2000 | Alexander, Jr. et al. |
| 6,394,015 | B1 | 5/2002 | Gabriel |
| 2012/0272885 | A1 | 11/2012 | Foley et al. |

FOREIGN PATENT DOCUMENTS

| | | | |
|---|---|---|---|
| DE | 1933771 | A1 | 1/1971 |
| FR | 2676706 | A1 | 11/1992 |
| WO | WO9822337 | A1 | 5/1998 |
| WO | WO2019086762 | | 5/2019 |

*Primary Examiner* — Lars A Olson

(74) *Attorney, Agent, or Firm* — Laine IP Oy

(57) ABSTRACT

According to an example aspect of the present invention, there is provided a manoeuvring system comprising at least one unit comprising a channel having a longitudinal axis and comprising at least one water intake opening, at least one water nozzle arranged within the channel and configured to guide a water flow through the at least one water intake opening at an angle relative to the longitudinal axis and in a plane perpendicular or substantially perpendicular to the Earth's normal, at least one piping connected to the channel at a first end and connected to the at least one water nozzle at a second end, and at least one pump arranged between the first end and the second end and configured to control a water flow through the at least one water nozzle.

13 Claims, 7 Drawing Sheets

MANOEUVRING SYSTEM FOR A VESSEL

FIELD

The present invention relates to a manoeuvring system. Certain embodiments of the present invention relate to a manoeuvring system for a vessel such as a ship, a motor boat, a sailing boat or a yacht.

Further, the present invention relates to an arrangement comprising a vessel and a manoeuvring system.

Even further, the present invention relates to a use of a manoeuvring system.

Furthermore, the present invention relates to a method of manufacturing a manoeuvring system.

Additionally, the present invention relates to a computer readable memory.

BACKGROUND

Different manoeuvring systems are known by means of which a user is able to manoeuver or navigate a vessel, for example in a harbour. Document WO 2019/086762 A1, for example, discloses a system, a software program product and a method for manoeuvring a boat. A plurality of water nozzles is provided on the boat. Further, a plurality of pumps is operated by a power source of the boat. The plurality of pumps is primed continuously to reduce response time to control the plurality of pumps and each of the plurality of pumps is connected to one water nozzle. A plurality of sensors is configured to monitor the state of motion of the boat. Further, an artificial intelligence module or control unit is in communication with the plurality of pumps, the plurality of sensors, and/or the plurality of water nozzles. The artificial intelligence module is configured to keep the boat in a stationary standstill or on a chosen course of motion.

U.S. Pat. No. 6,142,841 A, for example, further describes a maneuvering control system which utilizes pressurized liquid at three or more positions of a marine vessel in order to selectively create thrust that moves the marine vessel into required locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as required. A liquid distribution controller is provided which enables a vessel operator to use a joystick to selectively compress and dilate the distribution conduits to orchestrate the streams of water in a manner which will manoeuver the marine vessel as required.

Document WO 98/22337 A1, for example, discloses a hydraulic system for the control of boats, ships and crafts in general that comprises nozzles opposed at the end of the stem, having a Venturi tube throttling or an internal diameter reduction by means of flanges, so as to be able to determine, following to the outlet of the fluid under pressure, the movement by reaction of the front part of the boat and therefore to perform immediate leftward or rightward curvings according to the nozzle used, and/or corresponding nozzles, placed nearby the stern and with similar backward function, while the operating for hydraulic reaction of both nozzles placed on the same side determines the parallel movement of the whole craft, for coming alongside to quays or for performing other manoeuvres.

U.S. Pat. No. 6,394,015 B1 further describes a technique for reducing or preventing the impact force between two small boats or between a small boat and a large boat about to collide. The technique involves the blast of high pressure water from one of the boats against the other to push it aside. The water blasts would be directed against the hull of the threatening boat. A distance sensor can automatically initiate the water blasts by sensing the closeness between the two boats. For manual operation of the water blasts, a switch can be closed at any time that one so wishes, to avoid the collision. One or more adjustable nozzles on water outlets, operated remotely in different directions, enable the boat's pilot to direct the blasts where they would be most effective in averting a collision. Thus, the three options for the boat's captain are: 1. Manually switching on motor-driven pumps to blast water out of fixed nozzles, 2. remotely, angularly positioning nozzles from side to side or up and down, 3. automatic operation by allowing distance sensors to determine when to blast water against the hull of a threatening boat.

In view of the foregoing, it would be beneficial to provide a manoeuvring system, wherein safety of a vessel equipped with the manoeuvring system can be improved.

SUMMARY OF THE INVENTION

The invention is defined by the features of the independent claims. Some specific embodiments are defined in the dependent claims.

According to a first aspect of the present invention, there is provided a manoeuvring system comprising at least one unit comprising a channel having a longitudinal axis and comprising at least one water intake opening, at least one water nozzle arranged within the channel and configured to guide a water flow through the at least one water intake opening at an angle relative to the longitudinal axis and in a plane perpendicular or substantially perpendicular to the Earth's normal, at least one piping connected to the channel at a first end and connected to the at least one water nozzle at a second end, and at least one pump arranged between the first end and the second end and configured to control a water flow through the at least one water nozzle.

Various embodiments of the first aspect may comprise at least one feature from the following bulleted list:

- the system comprises 2 or 4 of said units or 2×n, where n is an integer number
- the system comprises an integer number of units, for example 1 or 2 units, each unit comprising a channel having a longitudinal axis and comprising a first water intake opening and a second water intake opening, wherein the water intake openings are arranged at opposite ends of the channel, a first water nozzle arranged within the channel and configured to guide a water flow through the first water intake opening at an angle relative to the longitudinal axis and in a plane perpendicular or substantially perpendicular to the Earth's normal, a second water nozzle arranged within the channel and configured to guide a water flow through the second water intake opening at an angle relative to the longitudinal axis and in a plane perpendicular or substantially perpendicular to the Earth's normal, a first piping connected to the channel at a first end and connected to the first water nozzle at a second end, a second piping connected to the channel at a first end and connected to the second water nozzle at a second end, a first pump arranged between the first end and the second end of the first piping and configured to control a water flow through the first water nozzle, and a second pump arranged between the first end and the second end of the second piping and configured to control a water flow through the second water nozzle the system comprises a processing unit comprising at least one processing core and at least one memory including computer program code the system comprises a user interface, for example a joystick with an additional wheel the system comprises a receiver configured to wirelessly receive data from a node, for example from a cloud server network wherein the system comprises a receiver configured to receive a position indication from an external positioning system, for example a GPS system the system comprises a transmitter configured to wirelessly transmit data to a node the system comprises at least one first sensor configured to determine a direction of movement of a vessel the system comprises at least one second sensor configured to monitor a state of motion of a vessel the system comprises at least one of the following: a magnetometer, a gyroscope, an accelerometer, a three-dimensional mapping sensor, a LIDAR, a LASER sensor, an ultrasound sensor, a three-dimensional video sensor, a two-dimensional video sensor, a location sensor, a GPS, an AGPS, a parking radar, a docking radar, an acceleration sensor, a wind sensor, and a water pressure sensor the system comprises an artificial intelligence module According to a second aspect of the present invention, there is provided an arrangement comprising a vessel and a manoeuvring system according to any one of claims 1-11.

According to a third aspect of the present invention, there is provided a use of a manoeuvring system according to any one of claims 1-11 in connection with mooring of a vessel, compensating a motion of the vessel caused by an external force, keeping position of the vessel, moving the vessel into a required direction, or preventing collision of the vessel with an object.

According to a fourth aspect of the present there is provided a method of manufacturing a manoeuvring system, the method comprising providing a hollow structure having a longitudinal axis and comprising at least one water intake opening, thus forming a channel, arranging at least one water nozzle within the channel, wherein the at least one water nozzle is configured to guide a water flow through the at least one water intake opening at an angle relative to the longitudinal axis and in a plane perpendicular or substantially perpendicular to the Earth's normal, connecting at least one piping to the channel at a first end and the at least one piping to the at least one water nozzle at a second end, and arranging at least one pump between the first end and the second end, wherein the at least one pump is configured to control a water flow through the at least one water nozzle.

According to a fifth aspect of the present invention, there is provided a non-transitory computer readable medium having stored thereon a set of computer implementable instructions capable of causing a processor, in connection with the arrangement according to claim 12, to receive a user input from a user via a user interface, receive a signal from at least one sensor and/or receive a signal from an external positioning system, calculate a required water flow through at least one water nozzle of a manoeuvring system, and transmit a control signal to at least one pump of the manoeuvring system.

Considerable advantages are obtained by means of certain embodiments of the present invention. A manoeuvring system for a vessel such as a motor boat is provided. According to the present invention, the number of openings in the hull of a vessel can be limited, as water is able to flow through the water intakes into the system and water can then be ejected through the water intake openings via a plurality of nozzles. For example, only four openings in the hull are necessary when providing the vessel with four units, wherein each unit has one water nozzle. An additional water intake in the hull is not required, thus improving safety of the vessel.

One pump is provided for each nozzle and the pumps can be primed in order to reduce control response time, thus resulting in a system responding immediately to a command from a user. Thus, stepless or virtually stepless control of the propulsion is possible due to use of a plurality of pumps in the system, wherein each pump has a sufficient response time.

Installation of the manoeuvring system in accordance with the present invention is further easy to perform and the system can be manufactured in industrial scale.

Additionally, cavitation can be avoided or at least reduced during use of the system due to a relatively large cross-sectional area of the water intake openings in comparison to the cross-sectional area of the piping systems and nozzles.

Furthermore, the system allows navigating a vessel, for example during mooring, without use of a main engine. Even unexperienced users are able to easily control the system via a user interface. According to certain embodiments, the present invention is further beneficial in connection with mooring of a vessel, compensating a motion of the vessel caused by an external force, keeping position of the vessel, moving the vessel into a required direction, or preventing collision of the vessel with an object.

According to certain embodiments of the present invention, system may be remotely operated by a user via a mobile device such as a smartphone or tablet computer.

EMBODIMENTS

In this document, the term "channel" is used. The "channel" can be either a recess having only one opening through which water can flow into the recess or a tunnel having two openings at opposite sides through which water can flow into the tunnel.

Figure 1:
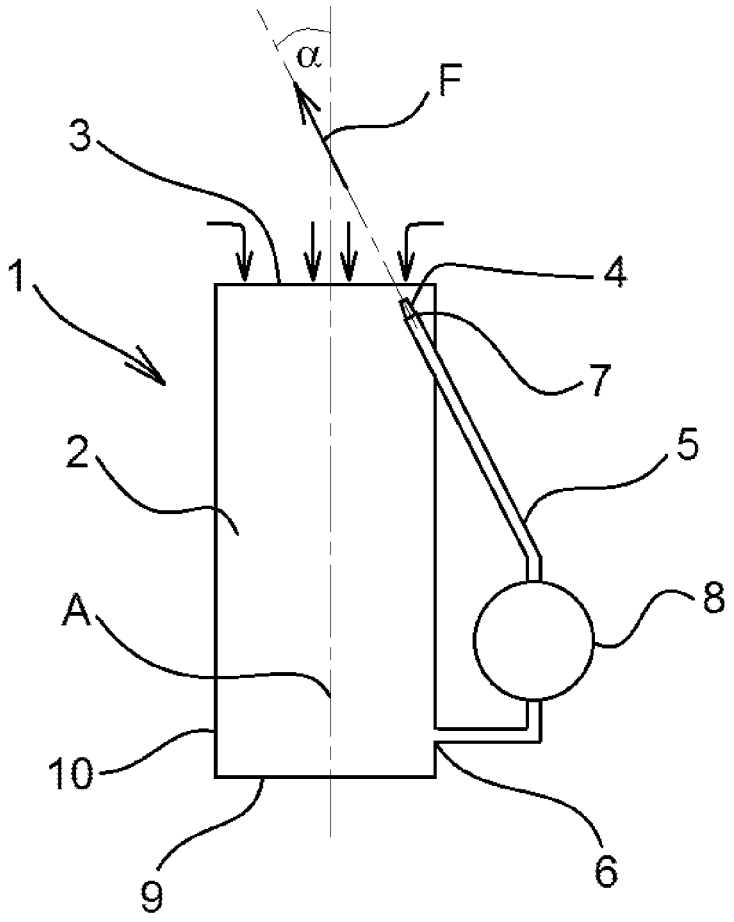
FIG. 1 illustrates a schematic view of a manoeuvring system in accordance with at least some embodiments of the present invention.

In FIG. 1 a schematic view of a manoeuvring system 1 in accordance with at least some embodiments of the present invention is illustrated. The manoeuvring system 1 is configured to be fixedly arranged below a water surface within a hull (not shown) of a vessel such as a motor boat.

The manoeuvring system 1 comprises a hollow structure 10 forming a channel 2 having a longitudinal axis A. The hollow structure 10 may be, for example, in the form of a hollow cylinder. The cross-section of the hollow structure 10 may also be formed in a different way, for example rectangular, elliptical, or polygonal. The shown hollow structure 10 has an opening at one end, thus forming a water intake opening 3 through which water is able to flow into the channel 2 as indicated by arrows. The water intake opening 3 may be shaped to correspond to a specific outer contour of the hull of the vessel. An opposite end of the shown hollow structure 10 is closed by a wall 9, thus forming a recess in the hull of the vessel. The material of the hollow structure is typically metal or plastic material. The material may be steel or aluminium, for instance.

The manoeuvring system 1 further comprises a water nozzle 4 arranged within the channel 2. The water nozzle 4 is configured to guide or eject a water flow F through the water intake opening 3 at an angle $\alpha$ relative to the longitudinal axis A and in a plane perpendicular or substantially perpendicular to the Earth's normal. The angle $\alpha$ is typically in a range between $0°<\alpha<90°$, preferably in a range between $15°<\alpha<75°$, for example 30° or 45°. Typically, the water flow F is directed in a plane perpendicular to the Earth's normal. However, as the manoeuvring system 1 is in use fixedly attached to the hull of the vessel and the vessel is, i.a., susceptible to waves, current and unevenly distributed loading, the water flow F is often also directed in a plane substantially perpendicular to the Earth's normal. For example, rolling of the vessel caused by waves might lead to a situation where the water flow F is temporarily guided through the water intake opening 3 at an angle $\alpha$ relative to the longitudinal axis A and in a plane substantially perpendicular to the Earth's normal. An area of cross-section of the nozzle 4 is less than an area of cross-section of the channel 2. Consequently, water flows into the channel 2 at a lower speed than the water to be ejected through the water nozzle 4, thus resulting in avoiding or at least reducing cavitation in the system 1.

The manoeuvring system 1 furthermore comprises a piping 5 connected to the channel 2 at a first end 6 and connected to the water nozzle 4 at a second end 7. The nozzle 4 may also be formed by the second end 7 of the piping system 5. As can be seen, the piping 5 is partially arranged outside of the channel 2 and partially arranged within the channel 2. Alternatively, the nozzle 4 may be integrated into the hollow structure 10 such that the piping 5 is arranged completely outside of the channel 2. A material of the piping 5 is typically metal or plastic material. The material may be steel or aluminium, for instance. Preferably, the material of the hollow structure 10 and the piping 5 are identical in order to allow welding of the components for providing a watertight structure.

A pump 8 is arranged between the first end 6 and the second end 7. The pump 8 is configured to control, create and/or adjust the water flow F through the water nozzle 4. In other words, a pump 8 is provided for ejecting water through the water nozzle 4. The pump 8 is configured to be operated by a power source. The power source may be a battery, a generator or a solar panel, for instance. Typically, the power of the pump 8 can be tuned continuously in order to control a pressure and/or a mass flow through the water nozzle 4. The pump 8 may be configured to be primed continuously to reduce control response time. By priming the pump 8, keeping electric power on the pumps and/or the inflow and/or outflow of the fluid present in the pump 8 is meant. The pump 8 may be a centrifugal pump, for instance.

Figure 2:
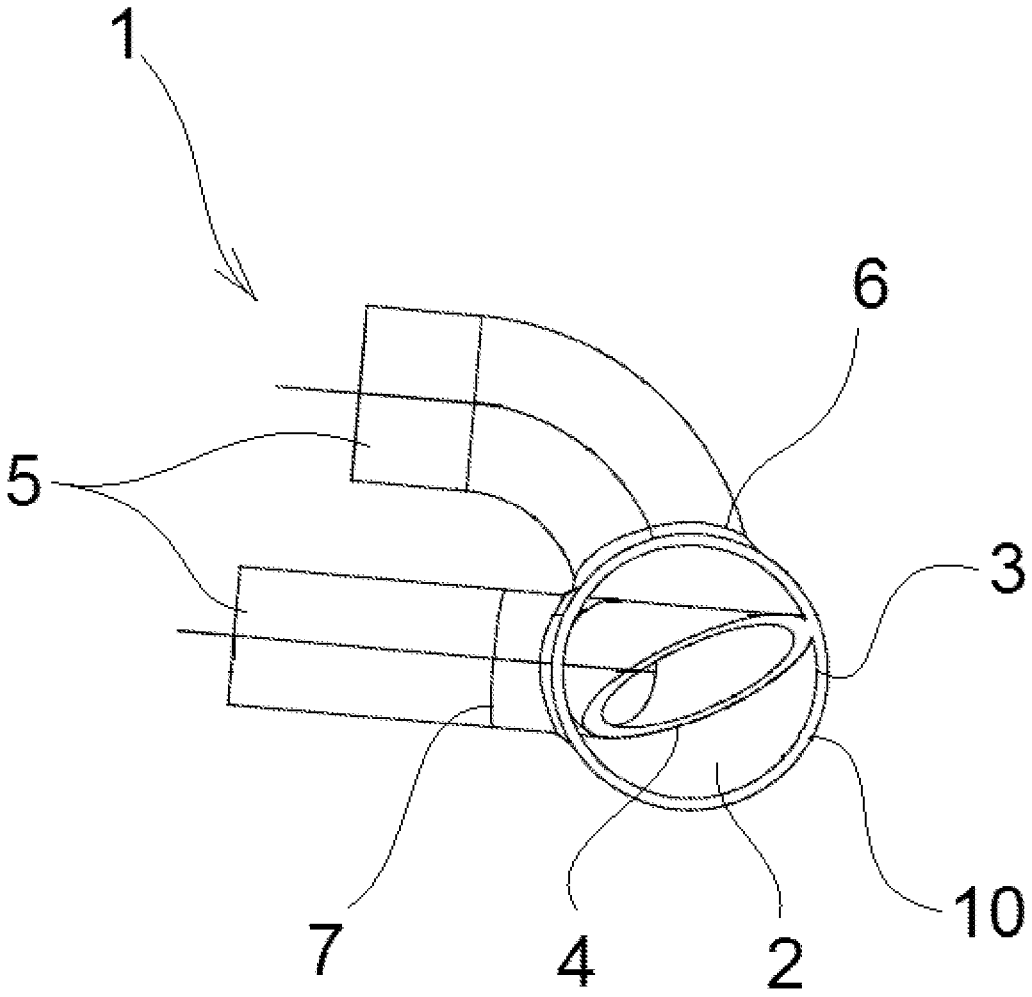
FIG. 2 illustrates a schematic view of a further manoeuvring system in accordance with at least some embodiments of the present invention.

In FIG. 2 a schematic view of a further manoeuvring system 1 in accordance with at least some embodiments of the present invention is illustrated. The manoeuvring system 1 comprises a hollow structure 10 in the form of a hollow cylinder, thus providing a channel 2 or recess having a water intake opening 3 through which water is able to flow into the channel 2. A piping 5 is connected to the channel 2 at a first end 6 and to a water nozzle 4 at a second end 7. The water nozzle 4 is arranged within the channel 2 and configured to guide a water flow through the water intake opening 3 at an angle relative to the longitudinal axis of the channel 2 and in a plane substantially perpendicular to the Earth's normal. As shown, the nozzle 4 points a few degrees downwards, for example 2-10 degrees downwards from the plane perpendicular to the Earth's normal. The water nozzle 4 may be formed by a part of the piping 5 or integral to piping 5. The water flow can be created by a pump (not shown) arranged between the first end and the second end of the piping 5. As can be seen, the diameter of the nozzle is less than the diameter of the hollow structure 10. The inner diameter of the hollow cylinder may be, for example, 110 mm. The diameter of the piping 5 and nozzle 4 may be, for example 68 mm. The shape of the nozzle 4 is end milled to the same level as the hollow structure 10.

Figure 3:
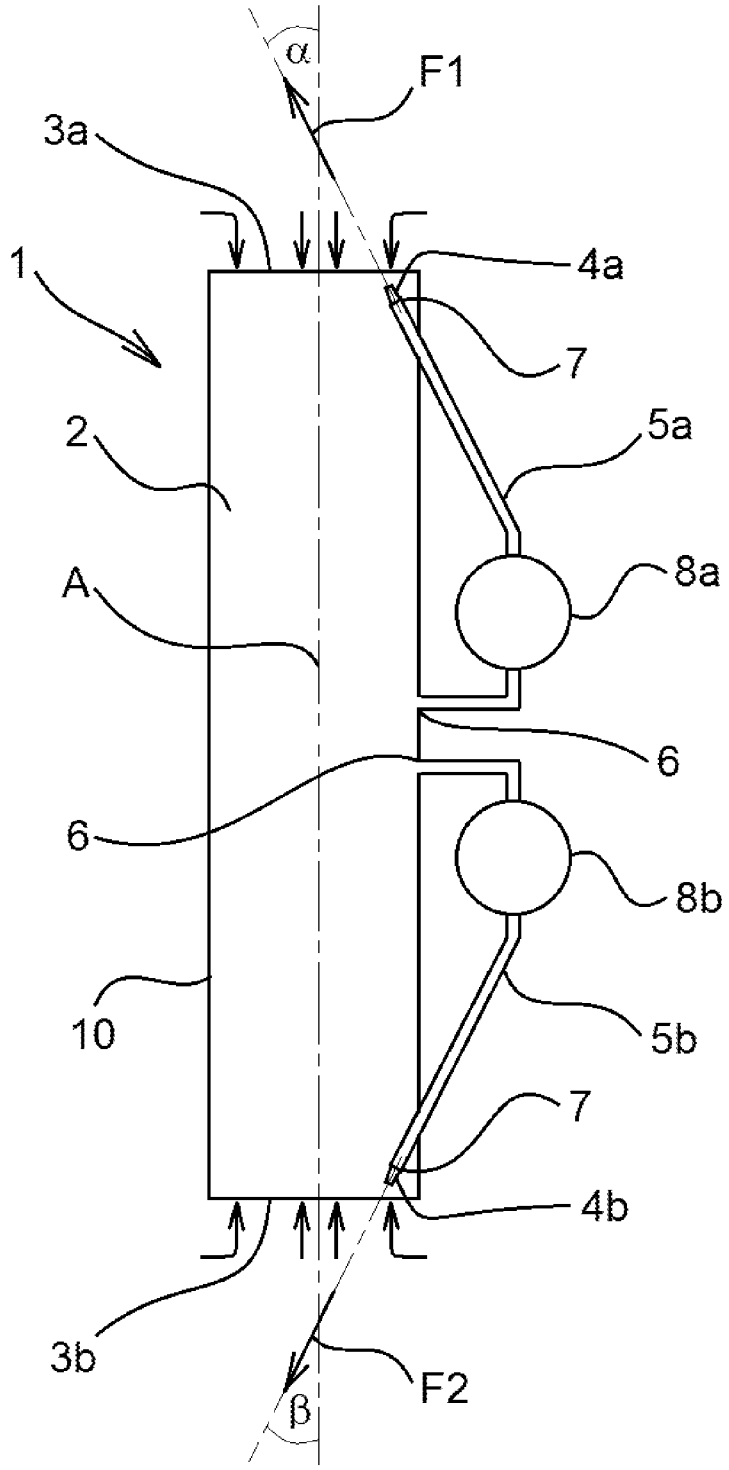
FIG. 3 illustrates a schematic view of another manoeuvring system in accordance with at least some embodiments of the present invention.

In FIG. 3 a schematic view of another manoeuvring system 1 in accordance with at least some embodiments of the present invention is illustrated. The manoeuvring system 1 is configured to be fixedly arranged below a water surface within a hull (not shown) of a vessel such as a motor boat.

The manoeuvring system 1 comprises a hollow structure 10 forming a channel 2 having a longitudinal axis A. The hollow structure 10 may be, for example, in the form of a hollow cylinder. The cross-section of the hollow structure 10 may also be formed in a different way, for example rectangular, elliptical, or polygonal. The shown hollow structure 10 has a first opening at one end and a second opening at a second opposite end, thus forming a first water intake opening 3*a* and a second water intake opening 3*b* through which water is able to flow from both sides of the channel 2 into the channel 2 as indicated by arrows. The water intake openings 3*a*, 3*b* may be shaped to correspond to a specific outer contour of the hull of the vessel. The length of the hollow structure 10 typically corresponds to the width of the hull of the vessel at the installation position of the hollow structure 10. In other words, a channel 2 is provided below the water surface through the entire hull of the vessel from the starboard side of the vessel to the port side of the vessel.

The manoeuvring system 1 further comprises a first water nozzle 4*a* and a second water nozzle 4*b* arranged within the channel 2. The first water nozzle 4*a* is configured to guide or eject a first water flow F1 through the first water intake opening 3*a* at an angle $\alpha$ relative to the longitudinal axis A and in a plane perpendicular or substantially perpendicular to the Earth's normal. The second water nozzle 4*b* is configured to guide or eject a second water flow F2 through the second water intake opening 3*b* at an angle $\beta$ relative to the longitudinal axis A and in a plane perpendicular or substantially perpendicular to the Earth's normal. The angles $\alpha$ and $\beta$ are typically identical. The angles $\alpha$ and $\beta$ are typically in a range between $0°<\alpha, \beta<90°$, preferably in a range between $15°<\alpha, \beta<75°$, for example 30° or 45°. Typically, the water flows F1, F2 are directed in a plane perpendicular to the Earth's normal. However, as the manoeuvring system 1 is in use fixedly attached to the hull of the vessel and the vessel is, i.a., susceptible to waves, current and unevenly distributed loading, the water flows F1, F2 are often also directed in a plane substantially perpendicular to the Earth's normal. For example, rolling of the vessel caused by waves might lead to a situation where the first water flow F1 and the second water flow F2 are temporarily guided through the water intake openings 3*a*, 3*b* at respective angles α, β relative to the longitudinal axis A and in a plane substantially perpendicular to the Earth's normal.

The manoeuvring system 1 furthermore comprises a first piping 5*a* connected to the channel 2 at a first end 6 and connected to the first water nozzle 4*a* at a second end 7. The nozzles 4*a*, 4*b* may also be formed by each second end 7 of the respective piping systems 5*a*, 5*b*. As can be seen, the first piping 5*a* and the second piping 5*b* are each partially arranged outside of the channel 2 and partially arranged within the channel 2. Alternatively, the nozzles 4*a*, 4*b* may be integrated into the hollow structure 10 such that the first piping 5*a* and the second piping 5*b* are arranged completely outside of the channel 2. A material of the first piping 5*a* and the second piping 5*b* is typically metal or plastic material. The material may be steel or aluminium, for instance. Preferably, the material of the hollow structure 10 and the first piping 5*a* as well as the second piping 5*b* are identical in order to allow welding of the components for providing a watertight structure.

A first pump 8*a* is arranged between the first end 6 and the second end 7 of the first piping 5*a*. The first pump 8*a* is configured to control, create and/or adjust the first water flow F1 through the first water nozzle 4*a*. Similarly, the manoeuvring system 1 comprises a second piping 5*b* connected to the channel 2 at a first end 6 and connected to the second water nozzle 4*a* at a second end 7. A second pump 8*b* is arranged between the first end 6 and the second end 7 of the second piping 5*b*. The second pump 8*b* is configured to control, create and/or adjust the second water flow F2 through the second water nozzle 4*b*. In other words, pumps 8*a*, 8*b* are provided for ejecting water through the water nozzles 4*a*, 4*b*. The pumps 8*a*, 8*b* are configured to be operated by a power source. The power source may be a battery, a generator or a solar panel, for instance. Typically, the power of the pumps 8*a*, 8*b* can be tuned continuously in order to control a pressure and/or mass flow through the water nozzles 4*a*, 4*b*. The pumps 8*a*, 8*b* may be configured to be primed continuously to reduce control response time. By priming the pumps 8*a*, 8*b*, keeping electric power on the pumps and/or the inflow and/or outflow of the fluid present in the pumps 8*a*, 8*b* is meant. One pump 8*a*, 8*b* is provided for each respective water nozzle 4*a*, 4*b*. The pumps 8*a*, 8*b* may be each a centrifugal pump, for instance.

Figure 4:
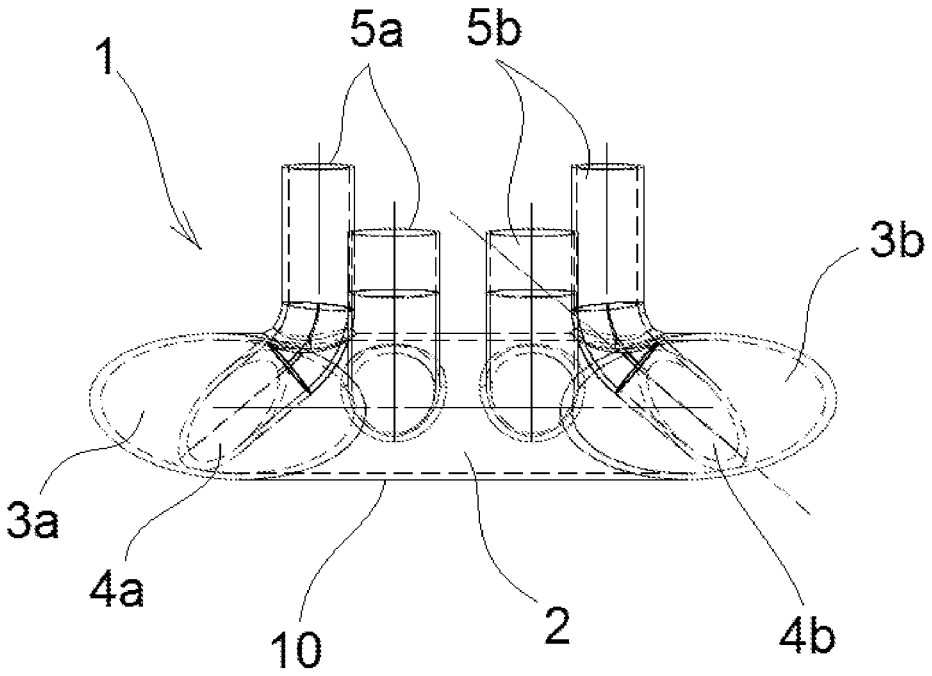
FIG. 4 illustrates a schematic view of a yet further manoeuvring system in accordance with at least some embodiments of the present invention.

In FIG. 4 a schematic view of a yet further manoeuvring system 1 in accordance with at least some embodiments of the present invention is illustrated. The system 1 comprises a hollow structure 10 having an elliptical cross section and two water intake openings 3*a*, 3*b* at opposite ends of the hollow structure 10, thus forming a channel 2. Water is able to flow into the channel 2 from both sides through the water intake openings 3*a*, 3*b*. A first piping 5*a* is connected to the channel 2 at a first end and to a first water nozzle 4*a* at a second end. Additionally, a second piping 5*b* is connected to the channel 2 at a first end and to a second water nozzle 4*b* at a second end. The water nozzles 4*a*, 4*b* are arranged within the channel 2 and configured to guide a water flow through the water intake openings 3*a*, 3*b* at an angle relative to the longitudinal axis of the channel 2 and in a plane substantially perpendicular to the Earth's normal. The water flow through each of the water nozzles 4*a*, 4*b* can be created by a respective pump (not shown), i.e. one pump is provided for each water nozzle. A pump is arranged between the first end and the second end of each piping 5*a*, 5*b*.

Figure 5:
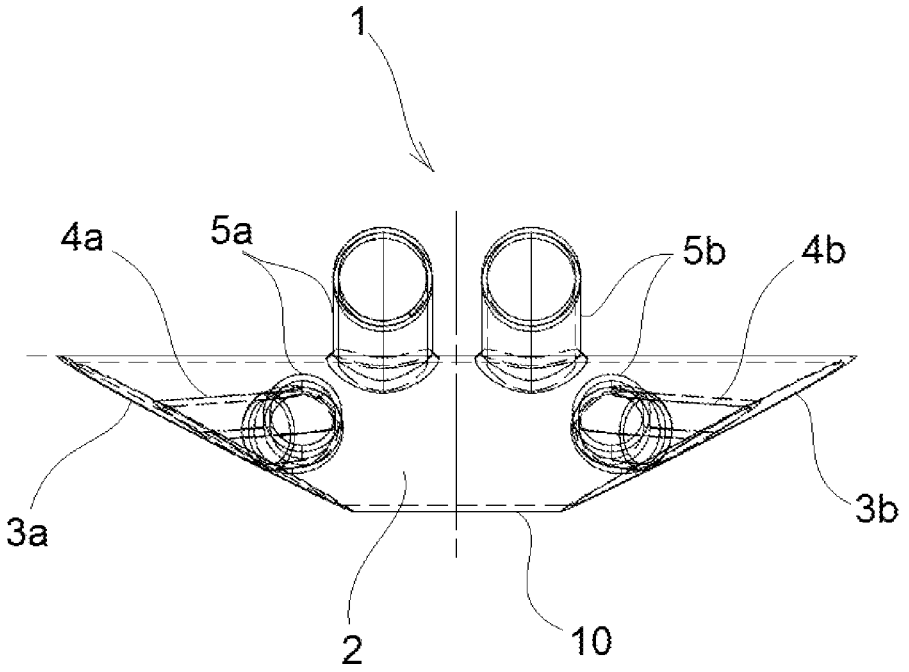
FIG. 5 illustrates a schematic view of an even further manoeuvring system in accordance with at least some embodiments of the present invention.

In FIG. 5 a schematic view of an even further manoeuvring system 1 in accordance with at least some embodiments of the present invention is illustrated. The system is designed to be installed in a motor boat having a V-shaped bottom structure below the water surface. The water nozzles 4*a*, 4*b* are arranged within the channel 2 and configured to guide a water flow through the respective water intake openings 3*a*, 3*b* at an angle relative to the longitudinal axis of the channel 2 and in a plane substantially perpendicular to the Earth's normal. As shown, the nozzles 4*a*, 4*b* each point a few degrees downwards, for example 2-10 degrees downwards from the plane perpendicular to the Earth's normal.

Figure 6:
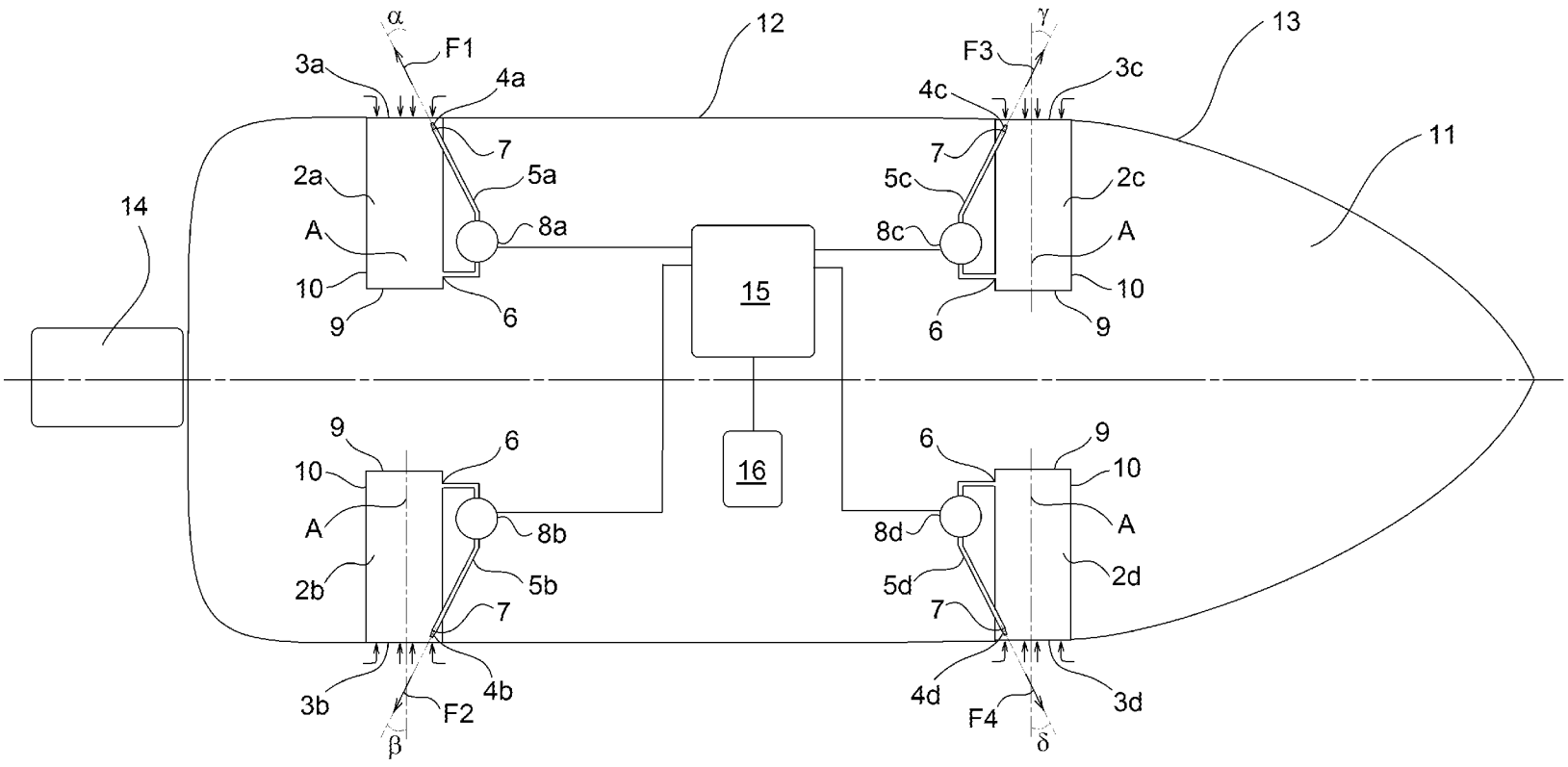
FIG. 6 illustrates a schematic view of an arrangement comprising a vessel and a manoeuvring system in accordance with at least some embodiments of the present invention.

In FIG. 6 a schematic view of an arrangement comprising a vessel 11 and a manoeuvring system 1 in accordance with at least some embodiments of the present invention is illustrated. Two units are fixedly attached to the hull 12 of the vessel 11 in the proximity of the stern of the vessel 11 and two further units are fixedly attached to the hull 12 of the vessel 11 in the proximity of the bow of the vessel 11. The longitudinal axis A of each unit is typically arranged in transversal direction of the vessel 11, i.e. perpendicular to the longitudinal axis of the vessel 11. However, the longitudinal axis A of each unit may also be inclined in relation to the transversal axis under certain circumstances, for example due to the shape of the hull 12 of the vessel 11.

Thus, two recesses in the hull 12 are provided at the port (left) side of the vessel 11 and two further recesses in the hull 12 are provided at the starboard (right) side of the vessel 11. Each recess has one water intake opening 3*a*, 3*b*, 3*c*, 3*d* into a channel 2*a*, 2*b*, 2*c*, 2*d* formed by a respective recess. The channels 2*a*, 2*b*, 2*c*, 2*d* are each orientated in a direction perpendicular or substantially perpendicular to a longitudinal axis of the vessel 11. To each channel 2*a*, 2*b*, 2*c*, 2*d* a respective piping 5*a*, 5*b*, 5*c*, 5*d* is coupled at its first end 6. To each piping 5*a*, 5*b*, 5*c*, 5*d* a respective water nozzle 4*a*, 4*b*, 4*c*, 4*d* is further coupled at the second end 7 of each piping. Between the first end 6 and the second end 7 of each piping 5*a*, 5*b*, 5*c*, 5*d* a respective pump 8*a*, 8*b*, 8*c*, 8*d* is arranged.

The nozzles 4*a*, 4*b* of the units in the proximity of the stern of the vessel 11 are configured to guide the respective water flows F1, F2 into a direction backwards and the nozzles 4*c*, 4*d* of the units in the proximity of the bow of the vessel 11 are configured to guide the respective water flows F3, F4 into a direction forwards. Of course, the nozzles 4*a*, 4*b* of the units in the proximity of the stern of the vessel 11 may also be configured to guide the respective water flows F1, F2 into a direction forwards and the nozzles 4*c*, 4*d* of the units in the proximity of the bow of the vessel 11 may then be configured to guide the respective water flows F3, F4 into a direction backwards.

Additionally, the arrangement comprises a processing unit 15 comprising at least one processing core and at least one memory including computer program code. The processing unit 15 is configured to receive a user input via a user interface 16. A user is able to control movements of the vessel 11 via the user interface 16.

According to the shown arrangement, a user is able to control the following translational movements of the vessel 11 via the user interface 16 without or in addition to controlling a main engine 14 and/or a rudder (not shown):

- moving the vessel forwards by controlling the flows F1 and F2
- moving the vessel backwards by controlling the flows F3 and F4
- moving the vessel to the starboard side by controlling the flows F1 and F3
- moving the vessel to the port side by controlling the flows F2 and F4
- moving the vessel forwards and to the starboard side by controlling the flows F1, F2 and F3
- moving the vessel forwards and to the port side by controlling the flows F1, F2 and F4
- moving the vessel backwards and to the starboard side by controlling the flows F1, F3 and F4
- moving the vessel backwards and to the port side by controlling the flows F2, F3 and F4

Instead or in addition to above mentioned translational movements, a user is further able to control the following rotational movements of the vessel 11 via the user interface without or in addition to controlling a main engine 14 and/or a rudder:

- clockwise rotation of the vessel around a vertical axis by controlling the flows F2 and/or F3
- counter-clockwise rotation of the vessel around a vertical axis by controlling the flows F1 and/or F4

The above mentioned translational and/or rotational movements may also be controlled by a computing device or an artificial intelligence module. It is to be pointed out that above movements may further be assisted by a flow not mentioned in above bulleted list due to e.g. an external aerodynamic and/or hydrodynamic force exerted on the hull 12 of the vessel 11 and detected by a sensor. For example, when the vessel 11 moves forward by simultaneously controlling flows F1 and F2 and a wave hits against the bow from the starboard side, the flow F3 may be temporarily activated by the processing unit 15 in order to steer the vessel 11 in the forward direction, i.e. to compensate for the temporarily impact of the wave. At least one of the flows F1, F2, F3, F4 may further be activated based on at least one signal of at least one sensor comprised by the arrangement.

According to a certain embodiment, the arrangement comprises only the two units in the proximity of the bow. In such an embodiment, the two units work as a bow thruster, i.e. only rotational movements of the vessel 11 in clockwise or counter-clockwise manner can be performed. In such an embodiment, the water nozzles 4*c*, 4*d* may be, for example, configured to guide a water flow F through the water intake openings 3*c*, 3*d* at an angle $\gamma$, $\delta=0°$ relative to the longitudinal axis A.

According to a certain embodiment, the arrangement comprises only the two units in the proximity of the stern. In such an embodiment, the two units work as a stern thruster, i.e. only rotational movements of the vessel 11 in clockwise or counter-clockwise manner can be performed. In such an embodiment, the water nozzles 4*a*, 4*b* may be, for example, configured to guide a water flow F through the water intake openings 3*a*, 3*b* at an angle $\alpha$, $\beta=0°$ relative to the longitudinal axis A.

Figure 7:
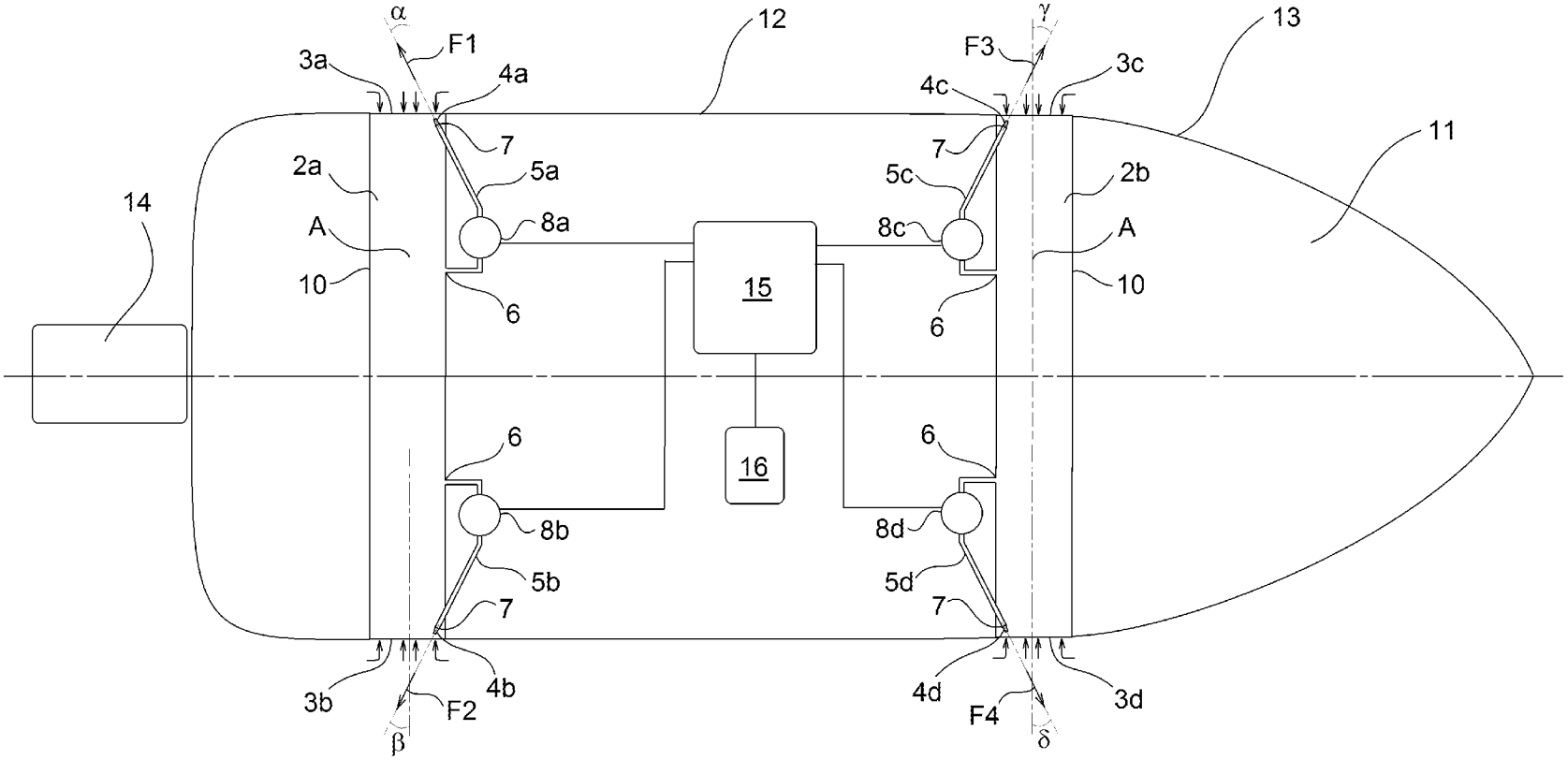
FIG. 7 illustrates a schematic view of another arrangement comprising a vessel and a manoeuvring system in accordance with at least some embodiments of the present invention.

In FIG. 7 a schematic view of another arrangement comprising a vessel and a manoeuvring system in accordance with at least some embodiments of the present invention is illustrated. One unit is fixedly attached to the hull 12 of the vessel 11 in the proximity of the stern of the vessel 11 and another unit are fixedly attached to the hull 12 of the vessel 11 in the proximity of the bow of the vessel 11. The longitudinal axis A of each unit is typically arranged in transversal direction of the vessel 11, i.e. perpendicular to the longitudinal axis of the vessel 11.

The first unit has a first water intake opening 3*a* and a second water intake opening 3*b* into a first channel 2*a*. The second unit has a third water intake opening 3*c* and a fourth water intake opening 3*d* into a second channel 2*b*. In other words, water is able to flow into the first channel 2*a* and the second channel 2*b* from both sides of the vessel 11. The channels 2*a*, 2*b* are each orientated in a direction perpendicular or substantially perpendicular to a longitudinal axis of the vessel 11.

To each channel 2*a*, 2*b* a respective piping 5*a*, 5*b*, 5*c*, 5*d* is coupled at its first end 6. To each piping 5*a*, 5*b*, 5*c*, 5*d* a respective water nozzle 4*a*, 4*b*, 4*c*, 4*d* is coupled at the second end 7 of each piping. Between the first end 6 and the second end 7 of each piping 5*a*, 5*b*, 5*c*, 5*d* a respective pump 8*a*, 8*b*, 8*c*, 8*d* is arranged.

The nozzles 4*a*, 4*b* of the unit in the proximity of the stern of the vessel 11 is configured to guide the respective water flows F1, F2 into a direction backwards and the nozzles 4*c*, 4*d* of the unit in the proximity of the bow of the vessel 11 is configured to guide the respective water flows F3, F4 into a direction forwards. Of course, the nozzles 4*a*, 4*b* of the unit in the proximity of the stern of the vessel 11 may also be configured to guide the respective water flows F1, F2 into a direction forward and the nozzles 4*c*, 4*d* of the unit in the proximity of the bow of the vessel 11 may then be configured to guide the respective water flows F3, F4 into a direction backwards.

Additionally, the arrangement comprises a processing unit 15 configured to receive a user input via a user interface 16. A user is able to control movements of the vessel 11 via the user interface 16. The user interface 16 may, for example, comprise a joystick for controlling translational movements of the vessel 11 and having an additional wheel for further controlling rotational movements of the vessel 11. The user interface 16 may, for example, also be a mobile device such as a smartphone or a tablet computer. Further, the user interface 16 may comprise a touchscreen or one or more push buttons.

According to the shown arrangement, a user is able to control the same translational and rotational movements of the vessel 11 as laid out in connection with FIG. 6 via the user interface without or in addition to controlling a main engine 14 and/or a rudder.

Typically, the arrangement comprises a plurality of sensors configured to monitor a motion of the vessel 11. At least one of the plurality of sensors may comprise a magnetometer, a gyroscope, a three-dimensional mapping sensor, a LIDAR, a LASER sensor, an ultrasound sensor, a three-dimensional video sensor, a two-dimensional video sensor, a location sensor, GPS (global positioning system), AGPS (augmented GPS), parking radar, docking radar, an acceleration sensor, a wind sensor, or a water pressure sensor.

According to a certain embodiment, the arrangement comprises only the unit in the proximity of the bow. In such an embodiment, the single unit works as a bow thruster, i.e. only rotational movements of the vessel 11 in clockwise or counter-clockwise manner can be performed. In such an embodiment, the water nozzles 4*c*, 4*d* may be, for example, configured to guide a water flow F through the water intake openings 3*c*, 3*d* at an angle $\gamma$, $\delta=0°$ relative to the longitudinal axis A.

According to a certain embodiment, the arrangement comprises only the unit in the proximity of the stern. In such an embodiment, the single unit work as a stern thruster, i.e. only rotational movements of the vessel 11 in clockwise or counter-clockwise manner can be performed. In such an embodiment, the water nozzles 4*a*, 4*b* may be, for example, configured to guide a water flow F through the water intake openings 3*a*, 3*b* at an angle α, β=0° relative to the longitudinal axis A.

Figure 8:
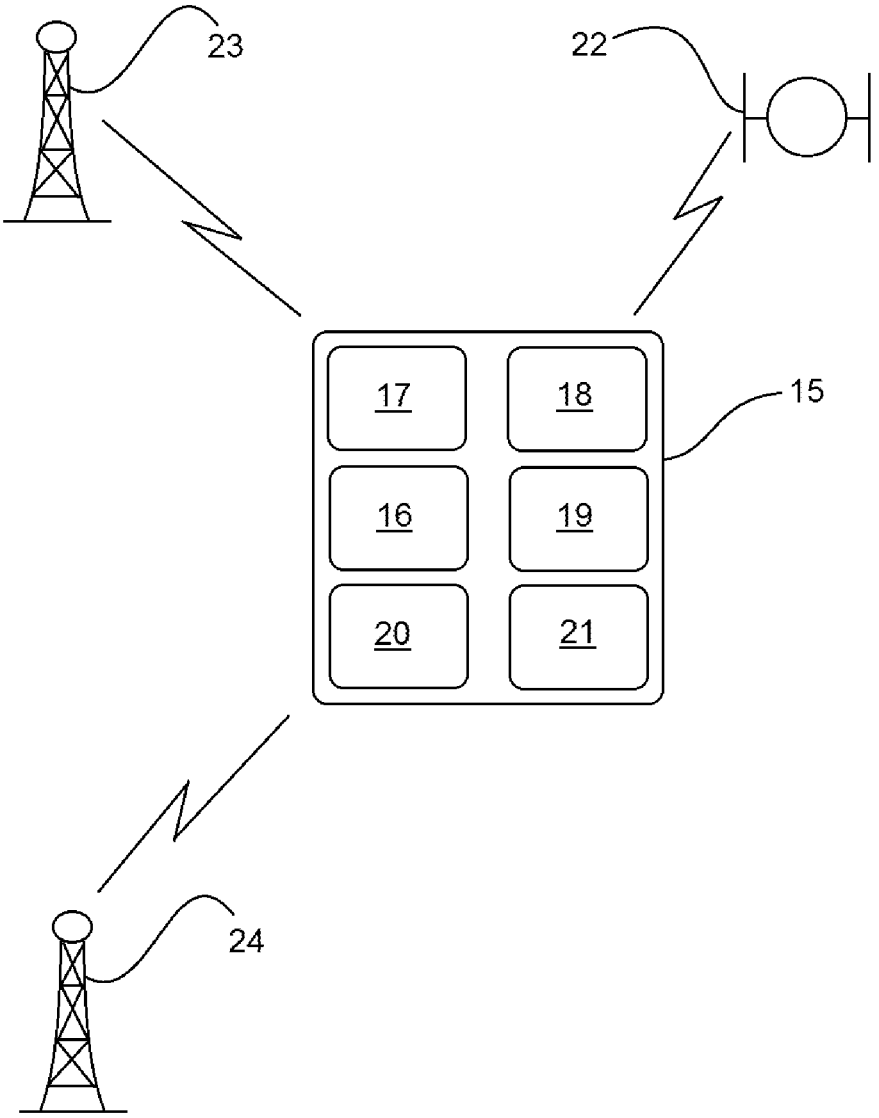
FIG. 8 illustrates a schematic view of a processing unit of a further manoeuvring system in accordance with at least some embodiments of the present invention.

In FIG. 8 a schematic view of a processing unit 15 of a further manoeuvring system in accordance with at least some embodiments of the present invention is illustrated. The processing unit 15 comprises at least one processing core 17. The processing core 17 may comprise, for example, a Cortex-A8 processing core manufactured by ARM Holdings or a Steamroller processing core produced by Advanced Micro Devices Corporation. The processing unit 15 may comprise at least one Qualcomm Snapdragon and/or Intel Atom processor, for instance. The processing unit 15 may be means for performing method steps in a manoeuvring system in accordance with at least some embodiments of the present invention. The processing unit 15 may be configured, at least in part by computer instructions, to perform actions. The processing unit 15 may calculate a required water flow through at least one water nozzle of the manoeuvring system 1. In particular a pressure of a water flow and/or a mass flow may be calculated for each water nozzle. Calculation of the water flow may be based on a received user input, received signal from at least one sensor and/or received signal from an external positioning system. A control signal for at least one pump may be determined by the processing unit 15 based on calculation of the water flow.

Further, the processing unit 15 comprises at least one memory 18. The at least one memory 18 may comprise random-access memory and/or permanent memory. The at least one memory 18 may comprise at least one RAM chip. The at least one memory may 18 comprise solid-state and/or magnetic memory, for example. The at least one memory 18 may be at least in part accessible to the processing core 17. The at least one memory 18 may be at least in part comprised in processing unit 15. The at least one memory may 18 be means for storing information. The at least one memory 18 may comprise computer instructions that the processing core 17 is configured to execute. When computer instructions configured to cause the processing core 17 to perform certain actions stored in the at least one memory 18, and the manoeuvring system overall is configured to run under the direction of the processing core 17 using computer instructions from the at least one memory 18, processing unit 15 and/or its at least one processing core 17 may be considered to be configured to perform said certain actions. The at least one memory 18 may be at least in part external to the manoeuvring system but accessible to the manoeuvring system.

Furthermore, the processing unit 15 may be furnished with a transmitter arranged to output information from processing unit 15, via electrical leads internal to the manoeuvring system, to other systems comprised in the manoeuvring system, for example to a plurality of pumps or a plurality of sensors. Such a transmitter may comprise a serial bus transmitter arranged to, for example, output information via at least one electrical lead to the at least one memory 18 for storage therein. Alternatively to a serial bus, the transmitter may comprise a parallel bus transmitter. Likewise processing unit 15 may comprise a receiver arranged to receive information in processing unit 15, via electrical leads internal to the manoeuvring system, from other systems comprised in the manoeuvring system, for example from the plurality of pumps or the plurality of sensors. Such a receiver may comprise a serial bus receiver arranged to, for example, receive information via at least one electrical lead from the at least one memory for processing in processing unit 15. Alternatively to a serial bus, the receiver may comprise a parallel bus receiver.

The processing unit 15 comprises a user interface 16 for receiving commands from a user. The user interface 16 may, for example, comprise a joystick for controlling translational movements of a vessel. The joystick may comprise an additional wheel for further controlling rotational movements of the vessel, for instance. The user interface 16 may, for example, comprise a mobile device such as a smartphone or a tablet computer. Further, the user interface 16 may comprise a touchscreen. The user interface 16 may comprise one or more push buttons, for instance. The user interface 16 may be capable of controlling the manoeuvring system 1 remotely. Additionally, the processing unit 15 and/or the user interface 16 may comprise a display 21 for displaying information.

The processing core 17, the at least one memory 18, transmitter, receiver, readout circuitry, display 21 and/or user interface 16 may be interconnected by electrical leads internal to the manoeuvring system in a multitude of different ways. For example, each of the aforementioned systems may be separately connected to a master bus internal to the manoeuvring system, to allow for the systems to exchange information. However, as the skilled person will appreciate, this is only one example and depending on the embodiment various ways of interconnecting at least two of the aforementioned systems may be selected without departing from the scope of the present invention.

Additionally, the processing unit 15 may comprise a receiver 19 configured to wirelessly receive data from a node 23, for example from a cloud server network. Further, the processing unit 15 may comprise a transmitter 20 configured to wirelessly transmit data to a node 24, for example to a cloud server network. The transmitter 20 may comprise more than one transmitter. The receiver 19 may comprise more than one receiver. The transmitter 20 and the receiver 19 may be configured to transmit and receive, respectively, information in accordance with at least one communication standard. The transmitter 20 and/or the receiver 19 may be configured to operate in accordance with global system for mobile communication, GSM, wideband code division multiple access, WCDMA, 5G, long term evolution, LTE, IS-95, wireless local area network, WLAN, Ethernet and/or worldwide interoperability for microwave access, WiMAX, standards, for example. The receiver 19 may be configured to receive signals from an external positioning system 22, for example a GPS satellite signal. Computer program code to be stored in the at least one memory 18 may be received by the receiver 19, for example in order to update computer program code of the manoeuvring system.

According to certain embodiments of the present invention, there is provided a non-transitory computer readable medium having stored thereon a set of computer implementable instructions capable of causing a processing unit 15, in connection with an arrangement as shown in FIG. 6 or FIG. 7, to receive a command from a user via a user interface 16, to calculate a required water flow F1, F2, F3, F4 for pumps 8*a*, 8*b*, 8*c*, 8*d*, and to transmit a control signal to at least one of the pumps 8*a*, 8*b*, 8*c*, 8*d* in order to move the vessel into a required direction.

According to certain embodiments of the present invention, there is provided a non-transitory computer readable medium having stored thereon a set of computer implementable instructions capable of causing a processing unit 15, in connection with an arrangement as shown in FIG. 6 or FIG. 7, to receive a signal from a user, to receive a signal from an external positioning system, to calculate a required water flow F1, F2, F3, F4 for pumps 8*a*, 8*b*, 8*c*, 8*d*, and to transmit a control signal to at least one of the pumps 8*a*, 8*b*, 8*c*, 8*d* in order to move the vessel to a predetermined position, for example a berth of the vessel.

According to certain embodiments of the present invention, there is provided a non-transitory computer readable medium having stored thereon a set of computer implementable instructions capable of causing a processing unit 15, in connection with an arrangement as shown in FIG. 6 or FIG. 7, to receive a signal from at least one sensor, to calculate a required water flow F1, F2, F3, F4 for pumps 8*a*, 8*b*, 8*c*, 8*d*, and to transmit a control signal to at least one of the pumps 8*a*, 8*b*, 8*c*, 8*d* in order to keep the vessel in a stationary standstill. Dynamic positioning may, for example, take place based on GPS and/or proximity sensors.

According to certain embodiments of the present invention, there is provided a non-transitory computer readable medium having stored thereon a set of computer implementable instructions capable of causing a processing unit 15, in connection with an arrangement as shown in FIG. 6 or FIG. 7, to receive a signal from at least one sensor, for example a proximity sensor, to calculate a required water flow F1, F2, F3, F4 for pumps 8*a*, 8*b*, 8*c*, 8*d*, and to transmit a control signal to at least one of the pumps 8*a*, 8*b*, 8*c*, 8*d* in order to avoid a collision of the vessel with an object, for example a pier, pile, or boat.

According to certain embodiments of the present invention, the system 1 comprises an artificial intelligence (AI) module. Continuous AI-assisted self-calibrating is possible, for example to compensate for changes in load or crew position on board. The AI module may be configured to control at least one of the water flows F1, F2, F3, F4 in order provide the compensation. Further, directional AI-assisted auto-compensation for external forces such as wind, current, waves etc. is possible. For example, the AI-module may be configured to compensate the impact of a wave by controlling at least one of the water flows F1, F2, F3, F4 in order to steer the vessel 11 into a desired direction. Furthermore, dynamic AI-assisted power optimisation during manoeuvring is possible. The AI module may be configured to initiate or control translational and/or rotational movements of the vessel either separately or simultaneously. The AI module is typically configured to receive signals from at least one sensor as specified in this document. The AI module communicates with the plurality of pumps and/or sensors in order to provide a specific operation. The AI module may be further configured to control the power source used to prime the plurality of pumps ejecting water through the nozzles. The AI module may deploy self-learning or machine learning techniques.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in equipping a vessel such as motor boat with an additional manoeuvring system.

REFERENCE SIGNS LIST

1 manoeuvring system
2 channel
2*a* first channel
2*b* second channel
2*c* third channel
2*d* fourth channel

3 water intake opening
3*a* first water intake opening
3*b* second water intake opening
3*c* third water intake opening
3*d* fourth water intake opening
4 water nozzle
4*a* first water nozzle
4*b* second water nozzle
4*c* third water nozzle
4*d* fourth water nozzle
5 piping
5*a* first piping
5*b* second piping
5*c* third piping
5*d* fourth piping
6 first end
7 second end
8 pump
8*a* first pump
8*b* second pump
8*c* third pump
8*d* fourth pump
9 wall
10 hollow structure
11 vessel
12 hull
13 outer contour
14 main engine
15 processing unit
16 user interface
17 processing core
18 memory
19 receiver
20 transmitter
21 display
22 external positioning system
23 node
24 node

CITATION LIST

Patent Literature
WO 2019/086762 A1
U.S. Pat. No. 6,142,841 A
WO 98/22337 A1
U.S. Pat. No. 6,394,015 B1
Non Patent Literature

The invention claimed is:

1. A maneuvering system comprising an integer number of units, each unit comprising:

a channel having a longitudinal axis and comprising a first water intake opening, wherein the water intake openings are arranged at opposite ends of the channel, a first water nozzle arranged within the channel and configured to guide a water flow through the first water intake opening at a first angle relative to the longitudinal axis and in a plane perpendicular or substantially perpendicular to the Earth's normal, a second water nozzle arranged within the channel and configured to guide a water flow through the second water intake opening at a second angle relative to the longitudinal axis and in the plane perpendicular or substantially perpendicular to the Earth's normal, a first piping connected to the channel at a first end and connected to the first water nozzle at a second end, a second piping connected to the channel at a first end and connected to the second water nozzle at a second end, a first pump arranged between the first end and the second end of the first piping and configured to control a water flow through the first water nozzle, and a second pump arranged between the first end and the second end of the second piping and configured to control a water flow through the second water nozzle.

2. The maneuvering system according to claim 1, further comprising a processing unit comprising at least one processing core and at least one memory including computer program code.

3. The maneuvering system according to claim 1, further comprising a user interface.

4. The maneuvering system according to claim 1, further comprising a receiver configured to wirelessly receive data from a node.

5. The maneuvering system according to claim 1, further comprising a receiver configured to receive a position indication from an external positioning system.

6. The maneuvering system according to claim 1, further comprising a transmitter configured to wirelessly transmit data to a node.

7. The maneuvering system according to claim 1, further comprising at least one first sensor configured to determine a direction of movement of a vessel.

8. The maneuvering system according to claim 1, further comprising at least one second sensor configured to monitor a state of motion of a vessel.

9. The maneuvering system according to claim 1, further comprising at least one of the following: a magnetometer, a gyroscope, an accelerometer, a three-dimensional mapping sensor, a LIDAR, a LASER sensor, an ultrasound sensor, a three-dimensional video sensor, a two-dimensional video sensor, a location sensor, a GPS, an AGPS, a parking radar, a docking radar, an acceleration sensor, a wind sensor, and a water pressure sensor.

10. An arrangement comprising a vessel and a maneuvering system according to claim 1.

11. Use of the maneuvering system according to claim 1 in connection with mooring of a vessel, compensating a motion of the vessel caused by an external force, keeping position of the vessel, moving the vessel into a required direction, or preventing collision of the vessel with an object.

12. A method of manufacturing a maneuvering system, the method comprising:

providing a hollow structure having a longitudinal axis and comprising a first water intake opening and a second water intake opening, thus forming a channel (2), wherein the water intake openings are arranged at opposite ends of the channel, arranging a first water nozzle within the channel, wherein the first water nozzle is configured to guide a water flow through the first water intake opening at a first angle relative to the longitudinal axis and in a plane perpendicular or substantially perpendicular to the Earth's normal, arranging a second water nozzle within the channel, wherein the second water nozzle is configured to guide a water flow through the second water intake opening at a second angle relative to the longitudinal axis and in the plane perpendicular or substantially perpendicular to the Earth's normal, connecting at first piping to the channel at a first end and to the first water nozzle at a second end, connecting a second piping to the channel at a first end and to the second water nozzle at a second end, arranging a first pump between the first end and the second end of the first piping, wherein the first pump is configured to control a water flow through the first water nozzle, and arranging a second pump between the first end and the second end of the second piping, wherein the second pump is configured to control a water flow through the second water nozzle.

13. A non-transitory computer readable medium having stored thereon a set of computer implementable instructions capable of causing a processor, in connection with the arrangement according to claim 10, to:

receive a user input from a user via a user interface, receive a signal from at least one sensor and/or receive a signal from an external positioning system, calculate a required water flow through at least one water nozzle of the maneuvering system, and transmit a control signal to at least one pump of the maneuvering system.

* * * * *